US009016235B2

(12) United States Patent
Ikagawa et al.

(10) Patent No.: US 9,016,235 B2
(45) **Date of Patent: *Apr. 28, 2015**

(54) SUBSTRATE COATING DEVICE THAT CONTROLS COATING AMOUNT BASED ON OPTICAL MEASUREMENT OF BEAD SHAPE

(75) Inventors: Yoshinori Ikagawa, Okayama (JP); Mitsunori Oda, Okayama (JP); Minoru Yamamoto, Okayama (JP); Takashi Kawaguchi, Okayama (JP); Masaaki Tanabe, Okayama (JP); Hideo Hirata, Okayama (JP)

(73) Assignee: Tazmo Co., Ltd, Okayama (JP)

( * ) Notice: Subject to any disclaimer, the term of this patent is extended or adjusted under 35 U.S.C. 154(b) by 500 days.

This patent is subject to a terminal disclaimer.

(21) Appl. No.: 13/256,562

(22) PCT Filed: Mar. 12, 2010

(86) PCT No.: PCT/JP2010/054219

§ 371 (c)(1),
(2), (4) Date: Sep. 14, 2011

(87) PCT Pub. No.: WO2010/106979

PCT Pub. Date: Sep. 23, 2010

(65) Prior Publication Data

US 2012/0000420 A1 Jan. 5, 2012

(30) Foreign Application Priority Data

Mar. 19, 2009 (JP) ..... 2009-067839

(51) Int. Cl.
*B05C 11/00* (2006.01)
*B05C 5/00* (2006.01)

(Continued)

(52) U.S. Cl.
CPC ..... *B05C 11/1007* (2013.01); *B05B 12/082* (2013.01); *B05C 5/0258* (2013.01); *B05C 11/1005* (2013.01)

(58) Field of Classification Search
CPC ..... B05C 11/1007; B05C 11/1005; B05C 11/1018; B05C 11/1021; B05C 5/0258; B05B 12/082; B05B 12/084; B05B 12/085; B05B 12/087; B05B 12/122; B05B 12/124
USPC ..... 118/688
See application file for complete search history.

(56) References Cited

U.S. PATENT DOCUMENTS 4,829,793 A * 5/1989 Holder et al. ..... 68/205 R
4,858,172 A * 8/1989 Stern ..... 700/40

(Continued)

FOREIGN PATENT DOCUMENTS

JP 07-080383 A 3/1995
JP 08-141467 A 6/1996

(Continued)

OTHER PUBLICATIONS

International Search Report for corresponding International Application No. PCT/JP2010/054219 mailed May 18, 2010.

*Primary Examiner* — Dah-Wei D Yuan
*Assistant Examiner* — Karl Kurple
(74) *Attorney, Agent, or Firm* — Renner, Otto, Boisselle & Sklar, LLP

(57) ABSTRACT

The substrate coating device (10) includes a slit nozzle (1), a first camera (3), a second camera (4), a control section (5), a pump (8), and a pressure control chamber (9). The control section (5) controls the supply of the coating liquid from the pump (8) to the slit nozzle (1) in accordance with the result of comparison between a bead shape imaged by the first camera (3) and a reference shape. The control section (5) also controls the air pressure on the upstream side of the slit nozzle (1) by the pressure control chamber (9) in accordance with the result of comparison between a distance measured from an image taken by the second camera (4) and a reference distance.

1 Claim, 4 Drawing Sheets

(51) Int. Cl.

| | |
|---|---|
| ***B05C 11/10*** | (2006.01) |
| ***B05C 5/02*** | (2006.01) |
| *B05D 1/30* | (2006.01) |
| *B05D 1/02* | (2006.01) |
| *B05B 12/08* | (2006.01) |

(56) References Cited

U.S. PATENT DOCUMENTS

| | | | | |
|---|---|---|---|---|
| 4,941,182 | A * | 7/1990 | Patel | 382/141 |
| 5,001,353 | A * | 3/1991 | Odake et al. | 250/461.1 |
| 5,380,366 | A * | 1/1995 | Becker et al. | 118/712 |
| 5,402,351 | A * | 3/1995 | Batchelder et al. | 700/119 |
| 5,666,325 | A * | 9/1997 | Belser et al. | 367/95 |
| 6,165,562 | A * | 12/2000 | Mizuno | 427/8 |
| 6,266,436 | B1 * | 7/2001 | Bett et al. | 382/141 |
| 6,296,708 | B1 * | 10/2001 | Coulibaly et al. | 118/679 |
| 6,299,931 | B1 * | 10/2001 | Leary et al. | 427/8 |
| 6,541,304 | B1 * | 4/2003 | Bouras et al. | 438/108 |
| 6,541,757 | B2 * | 4/2003 | Bieman et al. | 250/221 |
| 7,188,781 | B2 * | 3/2007 | Reighard et al. | 239/71 |
| 7,712,502 | B2 * | 5/2010 | Engelbart et al. | 156/351 |
| 8,255,088 | B2 * | 8/2012 | Burkus et al. | 700/283 |
| 8,297,222 | B2 * | 10/2012 | Weiss et al. | 118/696 |
| 8,944,001 | B2 * | 2/2015 | Suriawidjaja et al. | 118/712 |
| 2003/0201338 | A1 * | 10/2003 | Greene et al. | 239/225.1 |
| 2005/0016818 | A1 * | 1/2005 | Ito et al. | 198/345.1 |
| 2005/0100680 | A1 * | 5/2005 | Bustgens | 427/427.1 |
| 2005/0211797 | A1 * | 9/2005 | Abergel et al. | 239/333 |
| 2005/0218245 | A1 * | 10/2005 | Jarvis | 239/68 |
| 2005/0244569 | A1 * | 11/2005 | Estelle et al. | 427/8 |
| 2006/0073265 | A1 * | 4/2006 | Teichman et al. | 427/2.1 |
| 2007/0086021 | A1 * | 4/2007 | Teichman | 356/621 |
| 2008/0011951 | A1 * | 1/2008 | Delcher et al. | 250/339.03 |
| 2008/0309698 | A1 * | 12/2008 | Nakano et al. | 347/14 |
| 2009/0169718 | A1 * | 7/2009 | Casarini et al. | 427/8 |
| 2009/0202727 | A1 * | 8/2009 | Abas et al. | 427/284 |
| 2010/0108256 | A1 * | 5/2010 | Roajanasiri et al. | 156/291 |
| 2010/0209591 | A1 * | 8/2010 | Eriksson et al. | 427/8 |
| 2012/0085282 | A1 * | 4/2012 | Ikagawa et al. | 118/692 |
| 2012/0298038 | A1 * | 11/2012 | Ikushima | 118/712 |
| 2012/0315378 | A1 * | 12/2012 | Yapel et al. | 427/8 |
| 2013/0011548 | A1 * | 1/2013 | Umemoto et al. | 427/8 |
| 2014/0007810 | A1 * | 1/2014 | Hoshizawa | 118/713 |

FOREIGN PATENT DOCUMENTS

| | | | |
|---|---|---|---|
| JP | 11-309400 | A | 11/1999 |
| JP | 2003-247949 | A | 9/2003 |
| JP | 2006-167682 | A | 6/2006 |
| JP | 2006-272130 | A | 10/2006 |
| JP | 2008-091770 | A | 4/2008 |

* cited by examiner

SUBSTRATE COATING DEVICE THAT CONTROLS COATING AMOUNT BASED ON OPTICAL MEASUREMENT OF BEAD SHAPE

TECHNICAL FIELD

The present invention relates to a substrate coating device configured to coat a to-be-coated surface of a plate-shaped substrate, such as a glass substrate, with a coating liquid, such as a resist liquid, by scanning a nozzle relative to the substrate in one direction while delivering the coating liquid onto the to-be-coated surface of the substrate.

BACKGROUND ART

When coating a surface of a plate-shaped substrate, such as a glass substrate, with a coating liquid, use is made of a substrate coating device configured to scan a slit nozzle relative to the surface of the substrate in a predetermined scanning direction perpendicular to the slit with a spacing kept between the nozzle and the surface of the substrate.

In order to coat the surface of the substrate with a desired thickness of the coating liquid uniformly, the coating liquid needs to form a proper bead shape between the tip of the nozzle and the surface of the substrate.

Among conventional substrate coating devices, there is one which is configured to measure the pressure of a pump supplying the coating liquid to the nozzle and the mechanical vibration exerted on the substrate, estimate the bead shape of the coating liquid based on the results of the measurement, and control the discharge pressure of the pump and the spacing between the tip of the nozzle and the surface of the substrate so as to make the bead shape proper (see Patent Document 1).

PRIOR ART DOCUMENT

Patent Document

Patent Document 1: Japanese Patent Laid-Open Publication No. 2008-91770

DISCLOSURE OF THE INVENTION

Problems to be Solved by the Invention

The substrate coating device described in Patent Document 1, however, is incapable of recognizing a real bead shape accurately due to time errors and noise because the substrate coating device is not designed to measure the bead shape directly but is designed to estimate the bead shape from the results of measurement of physical values which are likely to have influence on the bead shape. For this reason, this substrate coating device has a problem that the amount of coating on the surface of the substrate with the coating liquid cannot be immediately controlled highly accurately.

Particularly, there is a problem that non-uniform film thickness areas (non-uniform areas) increase at the times when coating is started and ended. Such non-uniform areas take place because of an unstable rate of delivery of the coating liquid from the nozzle.

Like the substrate coating device described in Patent Document 1, any other conventional substrate coating device is not designed to directly measure the bead shape and hence cannot immediately control the amount of coating with the coating liquid highly accurately. Therefore, there has been no device which can solve the problems mentioned above.

An object of the present invention is to provide a substrate coating device which is capable of immediately controlling the amount of coating on the surface of the substrate with the coating liquid highly accurately by controlling parameters that exert influences the bead shape based on a result of direct measurement of the bead shape, thereby reducing the non-uniform areas which take place at the times when the coating is started and ended.

Means for Solving the Problems

A substrate coating device according to the present invention includes a nozzle, shape measuring means, shape altering means, and control means. The nozzle is configured to deliver a coating liquid onto a surface of a plate-shaped substrate and is movable relative to the surface of the substrate in a predetermined scanning direction while assuming a position spaced a predetermined distance from the surface of the substrate. The shape measuring means is configured to optically measure a bead shape of the coating liquid delivered from the nozzle on the substrate. The shape altering means is configured to alter a bead shape of the coating liquid being delivered from the nozzle. The control means is configured to prepare control data for controlling an operation of the shape altering means based on the bead shape measured by the shape measuring means.

With this construction, the bead shape of the coating liquid being delivered from the nozzle can be adjusted based on the result of the optical measurement of the bead shape of the coating liquid delivered onto the substrate. Therefore, the amount of coating on the surface of the substrate with the coating liquid can be immediately controlled highly accurately.

In the substrate coating device thus constructed, the shape measuring device preferably includes first image pickup means configured to image a bead shape of the coating liquid formed between the nozzle and the surface of the substrate from a position in a plane that is perpendicular to both the scanning direction and the surface of the substrate. The first image pickup means makes it possible to directly measure the bead shape of the coating liquid formed between the nozzle and the surface of the substrate.

Preferably, the substrate coating device further comprises a stage for placing the substrate on a top surface thereof, the stage having a through-hole extending therethrough from the top surface to a bottom surface thereof, wherein the shape measuring means includes second image pickup means located in the through-hole to image a surface of a translucent substrate placed on the stage. The provision of the second image pickup means makes it possible to directly measure the extents of non-uniform areas that take place at the times when coating is started and ended.

Preferably, the control means is configured to measure in the scanning direction a distance from a center of the nozzle to a boundary between a coated area of the surface of the substrate that is coated with the coating liquid and an uncoated area of the surface of the substrate that is uncoated with the coating liquid and then prepare the control data based on the result of the measurement thus performed. By so doing, the control means can easily calculate parameters for use in minimizing the non-uniform areas that take place at the times when coating is started and ended.

Preferably, the shape altering means is pressure control means disposed closely to the nozzle on an upstream side of the nozzle in the scanning direction to control an air pressure between the nozzle and the surface of the substrate. The bead shape can be easily controlled by adjusting the air pressure between the nozzle and the surface of the substrate.

Preferably, the shape altering means is supply control means configured to control a supply of the coating liquid to the nozzle. By controlling the supply of the coating liquid to the nozzle, it is possible to control the bead shape easily.

Advantage(s) of the Invention

The present invention is capable of immediately adjusting the amount of coating on the surface of the substrate with the coating liquid highly accurately by controlling the parameters that exert influence on the bead shape based on the result of direct measurement of the bead shape, thereby makes it possible to reduce the non-uniform areas that take place at the times when coating is started and ended.

BRIEF DESCRIPTION OF THE DRAWINGS

FIGS. 4A to 3C are each a view illustrating a distance between a coating boundary and a nozzle center in the substrate coating device.

BEST MODE FOR CARRYING OUT THE INVENTION

Hereinafter, a substrate coating device according to an embodiment of the present invention will be described with reference to the drawings.

Figure 1:
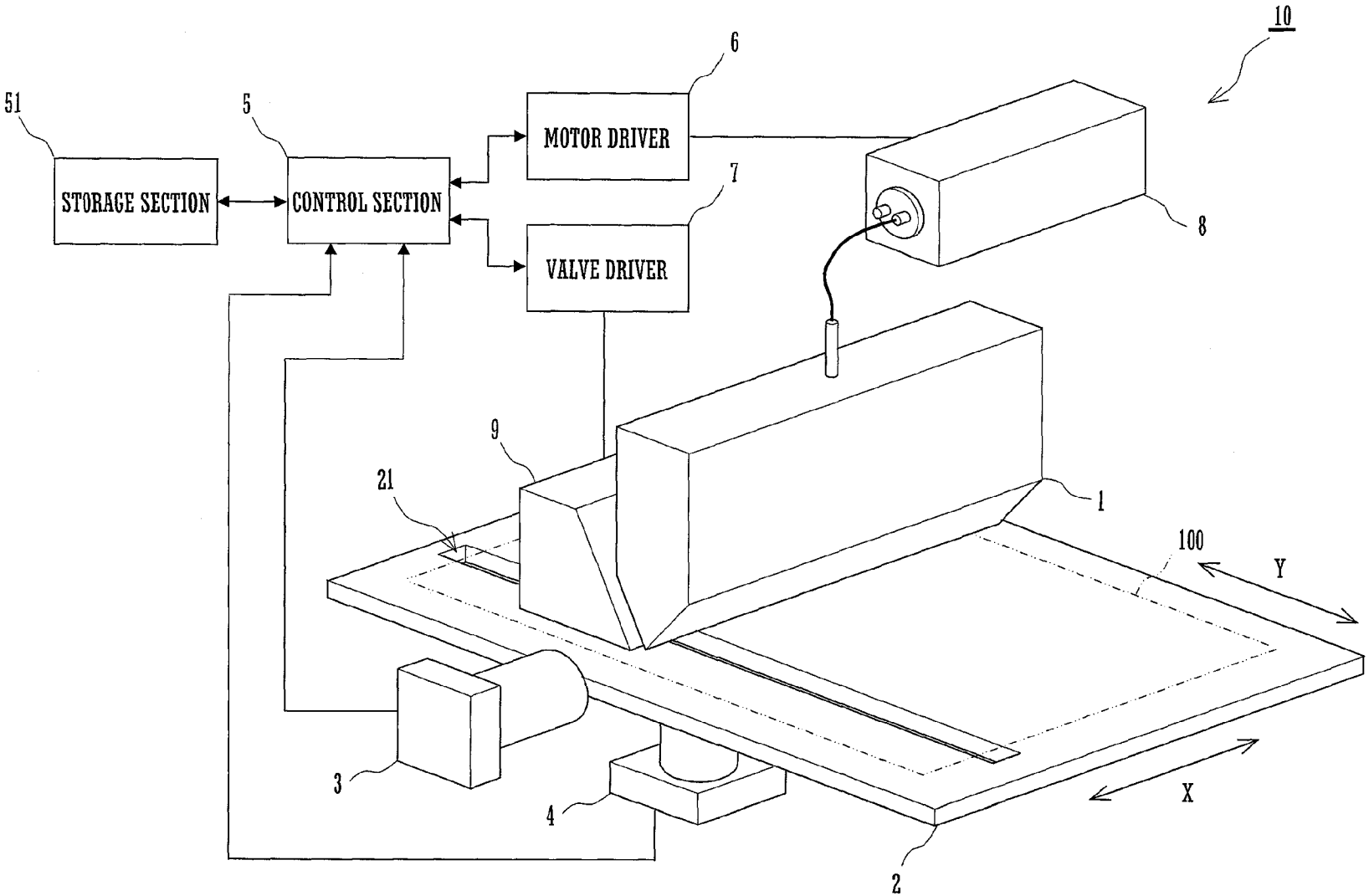
FIG. 1 is a schematic view illustrating a substrate coating device according to an embodiment of the present invention.

As illustrated in FIG. 1, a substrate coating device 10 according to an embodiment of the present invention includes a slit nozzle 1, a table 2, a first camera 3, a second camera 4, a control section 5, a motor driver 6, a valve driver 7, a pump 8, and a pressure control chamber 9.

The slit nozzle 1, which is the "nozzle" defined by the present invention, is configured to deliver a coating liquid from a slit which is formed at the bottom of the slit nozzle 1 and extends parallel with a direction indicated by arrow X. The table 2 has a top surface for placing a plate-shaped translucent substrate 100 thereon. The slit nozzle 1 is configured to move relative to the substrate 100 in a direction indicated by arrow Y which is perpendicular to the arrow X direction. The arrow Y direction is the "scanning direction" defined by the present invention. In an exemplary arrangement of the substrate coating device 10, the table 2 is moved in the arrow Y direction by means of a non-illustrated driving mechanism.

The first camera 3 is configured to image the space between the slit nozzle 1 and a surface of the substrate 100 from the arrow X direction which is parallel with the surface of the substrate 100 placed on the table 2. Thus, a bead shape of the coating liquid delivered from the slit nozzle 1 onto the surface of the substrate 100 can be imaged directly by the first camera 3.

The second camera 4 is disposed as opposed to the center of the bottom of the slit nozzle 1 across the table 2. The table 2 is formed with a through-hole 21 at a position opposed to the second camera 4. The second camera 4 is configured to image the surface of the substrate 100 through the through-hole 21.

The pump 8 supplies the coating liquid from a non-illustrated tank into a chamber provided in the slit nozzle 1 by revolution of a motor. The coating liquid is charged into the chamber of the slit nozzle 1 and then supplied to the nozzle. The rate of delivery of the coating liquid from the slit nozzle 1 is controlled by controlling the supply of the coating liquid from the pump 8. The pump 8 is a metering pump of the plunger or syringe type which can control the delivery rate of the coating liquid accurately.

The pressure control chamber 9 is disposed closely to the slit nozzle 1 on the upstream side in the arrow Y direction in which the slit nozzle 1 moves relative to the substrate 100. The pressure control chamber 9 is configured to control the air pressure between the slit nozzle 1 and the surface of the substrate 100. The pressure control chamber 9 controls the air pressure between the slit nozzle 1 and the surface of the substrate 100 on the downstream side of the slit nozzle 1 in the arrow Y direction by means of a pressurizing valve and a pressure-reducing valve.

The control section 5 is connected to the first camera 3, second camera 4, motor driver 6, and valve driver 7. The control section 5 is configured to prepare drive data corrected based on image data obtained by the first and second cameras 3 and 4 and output it to the motor driver 6 and the valve driver 7.

The motor driver 6 is configured to drive the motor of the pump 8 at an electric power in accordance with the drive data. The valve driver 7 opens and closes the pressuring valve or pressure-reducing valve of the pressure control chamber 9 in accordance with the drive data.

Figure 2:
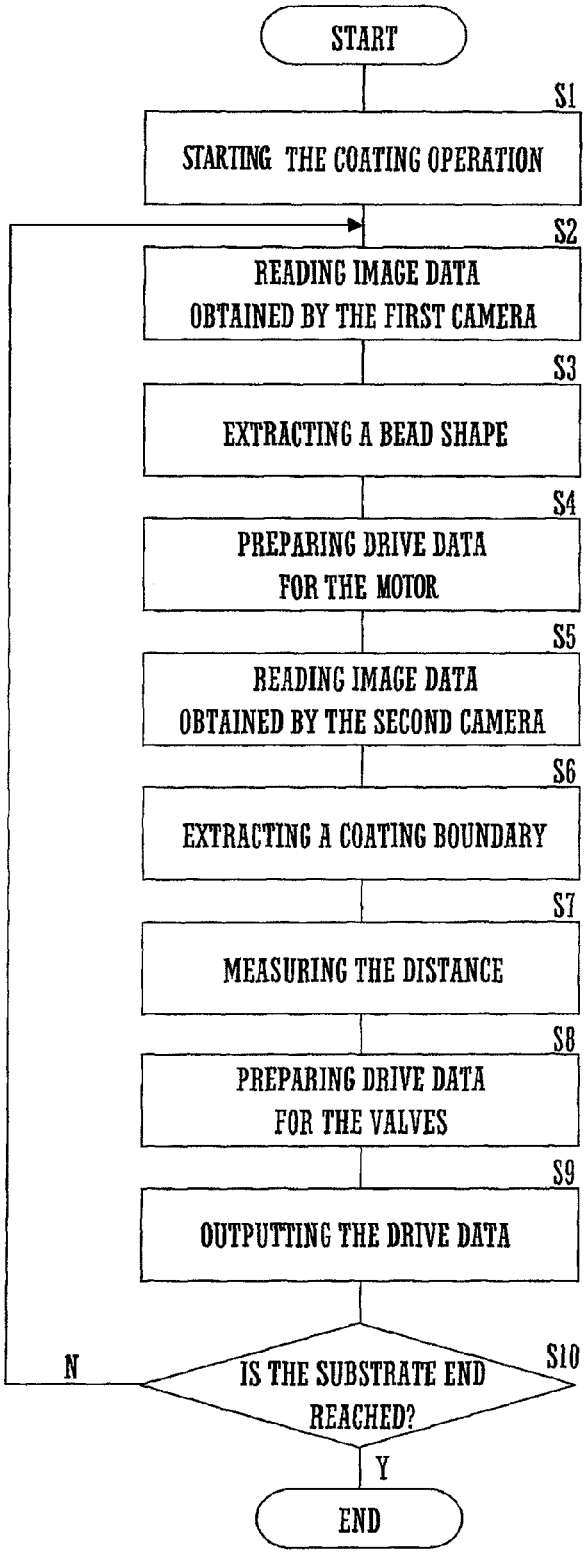
FIG. 2 is a flowchart of a process carried out by a control section of the substrate coating device.

As illustrated in FIG. 2, when the substrate 100 starts being coated with the coating liquid (step S1), the control section 5 of the substrate coating device 10 reads image data obtained by the first camera 3 (step S2). Then, the control section 5 extracts the bead shape of the coating liquid from the image taken by the first camera 3 (step S3) and prepares a drive data item to be outputted to the motor driver 6 by comparing the bead shape thus extracted to a reference shape previously stored in a storage section 51 (step S4).

Likewise, the control section 5 reads image data obtained by the second camera 4 (step S5). The control section 5 extracts a coating boundary between a coated area and an uncoated area of the surface of the substrate 100 by edge extraction from the image taken by the second camera 4 (step S6) and then measures the distance in the arrow Y direction between the coating boundary thus extracted and the center of the slit nozzle 1 (step S7). The control section 5 prepares a drive data item to be outputted to the valve driver 7 by comparing the distance thus measured to a reference distance previously stored in the storage section 51 (step S8).

The control section 5 outputs the drive data item prepared in step S4 and the drive data item prepared in step S8 to the motor driver 6 and the valve driver 7, respectively (step S9).

The control section 5 repeatedly continues at least the steps S2 to S4 until the amount of movement of the slit nozzle 1 relative to the substrate 100 reaches a predetermined value to complete the operation of coating the substrate 100 with the coating liquid (step S10).

The reference shape previously stored in the storage section 51 can be experimentally obtained, for example, by observing different coating states of the coating liquid on the surface of the substrate 100 with varying supply of the coating liquid from the pump 8 while imaging corresponding bead shapes by the first camera 3. That bead shape which has yielded a favorable coating state on the surface of the substrate 100 is previously stored as the reference shape in the storage section 51.

The reference distance previously stored in the storage section 51 can be experimentally obtained, for example, by measuring different distances between the center of the slit nozzle 1 and coating boundaries with varying supply of the coating liquid from the pump 8 while imaging the surface of the substrate 100 by the second camera 4. That distance which has yielded favorable coating states on the surface of the substrate 100 at the start and the end of coating is previously stored as the reference distance in the storage section 51.

Figure 3A:
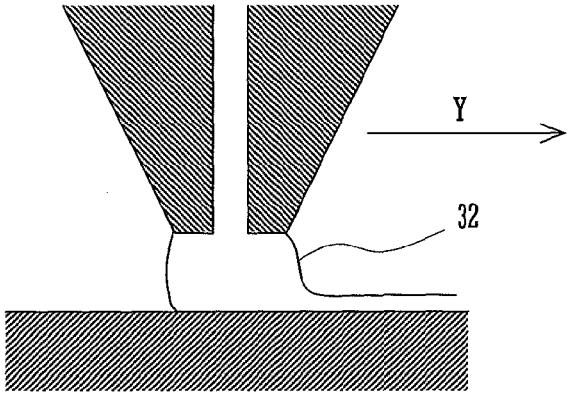
FIGS. 3A to 3C are each a view illustrating a bead shape of a coating liquid in the substrate coating device.
Figure 3B:
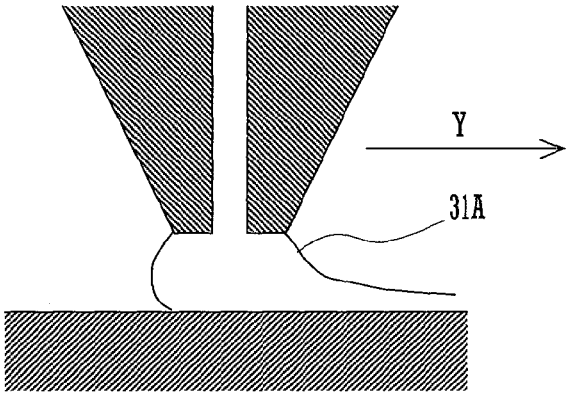
Figure 3C:
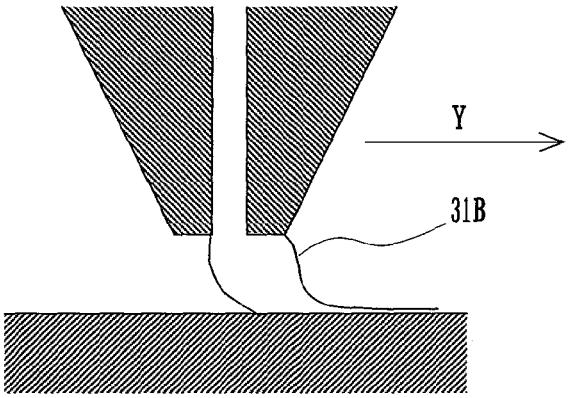

As illustrated in FIGS. 3A to 3C, the image of a bead shape 31A or 31B taken by the first camera 3 is compared to a reference shape 32 by the steps S2 to S4 during the operation of coating the surface of the substrate 100 with the coating liquid. If the first camera 3 has taken the bead shape image 31A, the drive data for the motor of the pump 8 is changed so as to decrease the supply of the coating liquid to the slit nozzle 1. Alternatively, if the first camera 3 has taken the bead shape image 31B, the drive data for the motor of the pump 8 is changed so as to increase the supply of the coating liquid to the slit nozzle 1.

In this way, the supply of the coating liquid to the slit nozzle 1 is controlled in such a manner that the surface of the substrate 100 is coated with a desired thickness of the coating liquid uniformly, thereby keeping the coating liquid in a favorable coating state on the surface of the substrate 100.

Figure 4A:
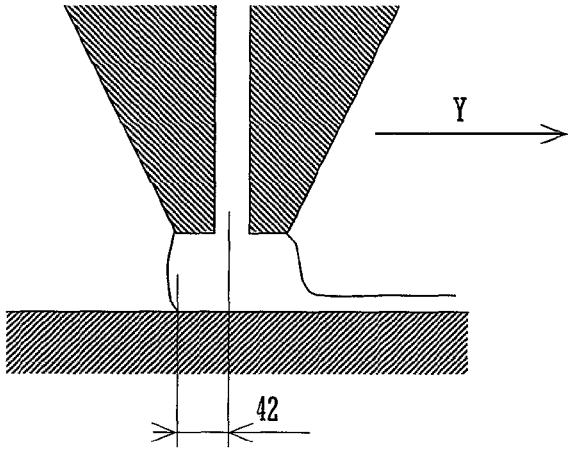
Figure 4B:
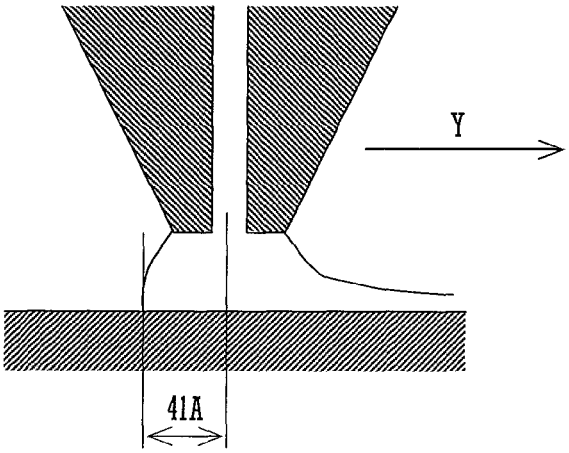
Figure 4C:
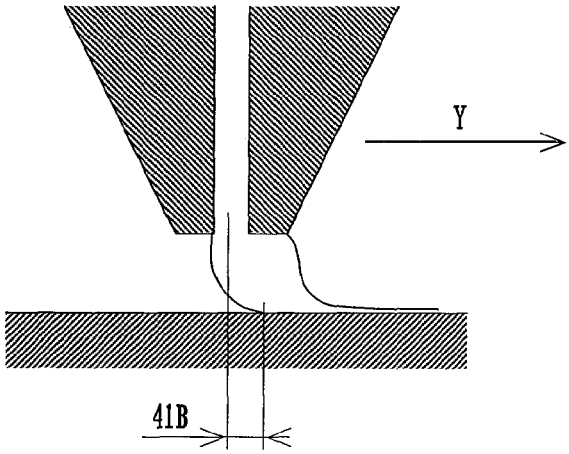

As illustrated in FIGS. 4A to 4C, a distance 41A or 41B measured from the image taken by the second camera 4 is compared to a reference distance 42 by the steps S5 to S8 during the operation of coating the surface of the substrate 100 with the coating liquid. If the distance 41A has been measured from the image taken by the second camera 4, the drive data is outputted to the pressurizing valve of the pressure control chamber 9. Alternatively, if the distance 41B has been measured from the image taken by the second camera 4, the drive data is outputted to the pressure-reducing valve of the pressure control chamber 9.

In the step S7, the distance from the center of the nozzle 1 to the edge of the coated area of the surface of the substrate 100 in the arrow Y direction is measured. When the distance from the center of the nozzle 1 is on the upstream side in the arrow Y direction, the distance is represented as a positive value. When the distance from the center of the nozzle 1 is on the downstream side in the arrow Y direction, the distance is represented as a negative value. In the example illustrated in FIG. 4C, the distance 41B is a negative value.

In this way, the air pressure between the slit nozzle 1 and the surface of the substrate 100 on the upstream side in the arrow Y direction is adjusted so as to reduce the non-uniform film thickness areas of the surface of the substrate 100 at the coating start position and at the coating end position. In cases where plural areas of the surface of single substrate 100 which are spaced apart from each other in the scanning direction are coated with the coating liquid, plural coating start positions and plural coating end positions are present. Nevertheless, it is possible to reduce non-uniform film thickness areas at all the coating start positions and at all the coating end positions.

The drive data for the motor of the pump 8, as well as the drive data for the valves of the pressure control chamber 9, may be prepared based on the image taken by only one of the first and second cameras 3 and 4.

Alternatively, the drive data for the motor of the pump 8, as well as the drive data for the valves of the pressure control chamber 9, may be prepared based on both the result of comparison between the bead shape image taken by the first camera 3 and the reference shape and the result of comparison between the distance measured from the image taken by the second camera 4 and the reference distance.

If the coating state of the coating liquid on the surface of the substrate 100 can be kept favorable by controlling one of the operation of the motor of the pump 8 and the operation of the valves of the pressure control chamber 9 and, hence, the non-uniform film thickness areas which take place at the times when coating is started and ended can be reduced, control of the other operation may be eliminated.

In cases where the substrate 100 to be coated with the coating liquid is not translucent, the surface of the substrate 100 cannot be imaged by the second camera 4. In such cases, the distance between the center of the slit nozzle 1 and the coating boundary on the upstream side in the arrow Y direction may be measured from an image taken by the use of a translucent test sheet prior to the operation of coating the substrate 100 with the coating liquid.

Subjects of control by the control section 5 are not limited to the motor of the pump 8 and the valves of the pressure control chamber 9. Instead of or together with these subjects, other parameters, including for example the velocity of relative movement between the slit nozzle 1 and the substrate 100, which can exert influence on the coating state of the coating liquid on the surface of the substrate 100 may be controlled by the control section 5.

The foregoing embodiment should be construed to be illustrative and not limitative of the present invention in all the points. The scope of the present invention is defined by the following claims, not by the foregoing embodiment. Further, the scope of the present invention is intended to include the scopes of the claims and all possible changes and modifications within the senses and scopes of equivalents.

DESCRIPTION OF REFERENCE CHARACTERS

1 slit nozzle, 2 table, 3 first camera, 4 second camera, 5 control section, 6 motor driver, 7 valve driver, 8 pump, 9 pressure control chamber, 10 substrate coating device, 21 through-hole, 32 reference shape, 42 reference distance, 100 substrate

The invention claimed is:

1. A substrate coating device comprising:

a nozzle configured to deliver a coating liquid onto a surface of a plate-shaped substrate, said substrate is plate-shaped and translucent, the nozzle being movable relative to the surface of the substrate in a predetermined scanning direction while assuming a position spaced a predetermined distance from the surface of the substrate and said nozzle delivers coating liquid onto the surface of the substrate;

a first camera configured to image a bead shape of the coating liquid formed between the nozzle and the surface of the substrate from a position in a plane that is perpendicular to both the scanning direction and the surface of the substrate:

a stage for placing the substrate on a top surface thereof, the stage having a through-hole extending therethrough from the top surface to a bottom surface thereof, a second camera located in the through-hole to image a shape of the coating liquid on the surface of the substrate placed on the stage;

a pump configured to control a supply of the coating liquid to the nozzle, a pressure control chamber disposed closely to the nozzle on an upstream side of the nozzle in the scanning direction to control an air pressure between the nozzle and the surface of the substrate; and a controller configured to prepare control data for controlling an operation of the pump and the pressure control chamber based on a result of imaging by the first camera and the second camera, wherein the controller is configured, when preparing the control data, to compare the bead shape imaged by the first camera to a reference shape, and to compare a distance from between a coating boundary of the coating liquid on the surface on the surface of the substrate and a center of the nozzle in the image imaged by the second camera to a center of the nozzle to a reference distance.

* * * * *